US006406446B1

(12) United States Patent
Takagi et al.

(10) Patent No.: US 6,406,446 B1
(45) Date of Patent: Jun. 18, 2002

(54) HIGH VELOCITY CURRENT PRODUCING APPARATUS

(75) Inventors: Kazumi Takagi; Yoshitaka Morinaka; Kenichi Ito; Masaru Mochizuki, all of Fugi (JP)

(73) Assignee: Takagi Industrial Co., Ltd., Shizuoka-ken (JP)

( * ) Notice: Subject to any disclaimer, the term of this patent is extended or adjusted under 35 U.S.C. 154(b) by 0 days.

(21) Appl. No.: 09/267,372

(22) Filed: Mar. 15, 1999

(30) Foreign Application Priority Data

Apr. 16, 1998 (JP) ..... 10-106587

(51) Int. Cl.[7] ..... A61H 9/00; A61H 33/02

(52) U.S. Cl. ..... 601/157; 601/158; 4/541.4; 4/541.5

(58) Field of Search ..... 601/155–8, 167, 601/169; 606/131; 4/568, 567, 541.3, 541.4, 541.5

(56) References Cited

U.S. PATENT DOCUMENTS 3,302,640 A * 2/1967 Jacuzzi
3,452,370 A * 7/1969 Jacuzzi
3,580,247 A * 5/1971 Schneider ..... 601/157
3,874,374 A * 4/1975 Jacuzzi
4,404,697 A * 9/1983 Hatcher
4,458,676 A * 7/1984 Pilleggi
4,933,999 A * 6/1990 Mikiya et al.
5,526,538 A * 6/1996 Rainwater ..... 4/541.1

FOREIGN PATENT DOCUMENTS

JP 1-178028 12/1989
JP 2502192 4/1996

* cited by examiner

*Primary Examiner*—Danton D. DeMille
(74) *Attorney, Agent, or Firm*—Connolly Bove Lodge & Hutz LLP

(57) ABSTRACT

The present invention provides a high velocity current producing apparatus in a bathtub capable of producing high velocity current having an appropriate pressure in a bathtub with a simple construction, and capable of enhancing operability, functional property and safety without narrowing the space in the bathroom. The high velocity current producing apparatus in a bathtub produces the high velocity current in the bathtub by connecting a pump to a circulation passage for circulating hot water in a bathtub to components provided outside the bathtub and the hot water sucked from the bathtub to the circulation passage is pressurized and supplied to the bathtub, wherein the high velocity current is used for massaging a body of a bather.

5 Claims, 16 Drawing Sheets

HIGH VELOCITY CURRENT PRODUCING APPARATUS

BACKGROUND OF THE INVENTION

1. Field of the Invention

The present invention relates to a high velocity current producing apparatus in a bathtub capable of producing high velocity water current (hereinafter referred to as high velocity current) in a bathtub using hot water in the bathtub and capable of using the high velocity current for massaging a body of a bather.

2. Description of the Prior Art

When water current having appropriate pressure is applied to a skin of a bather during bathing, stimulus caused by the pressure or shock of water against the skin and friction between the water current and the skin can be applied to the skin, and hence it has been expected to have an effect which is the same as or beyond the effect of the finger treatment. It is well known that bathing, and massage during bathing as well as a bathing effect caused by soaking a bather's body in hot water are effective for recovering from fatigue, and so forth. If the massage during bathing is added to the pressure or shock of water against the skin and friction between the water current and the skin, the effect of recovery from the fatigue and the promotion of health can be expected. Such a massaging apparatus is disclosed in Japanese Utility Model Registration No. 2502192 entitled "Beauty promotion apparatus in a bath" or in Japanese Utility Model Laid-Open Publication No. 1-178028 entitled "liquid jet massaging apparatus".

Although an apparatus of this type is installed adjacent to a bathtub and is convenient as a simple current producing apparatus, the installation of this apparatus narrows the bathroom and the pulling power supply codes in the bathroom needed careful handling in view of securing safety.

Further, the pulling of a hose in the bathtub from the outside of the bathtub while crossing the side wall of the bathtub is troublesome and not functional. If a bather operates the hose to apply water current to a desired position of his or her body, it is necessary to pay attention to the relation between the hose and the apparatus in the bathtub in view of operating the hose, which results in the troublesome handling.

SUMMARY OF THE INVENTION

Accordingly, it is an object of the present invention to provide a high velocity current producing apparatus in a bathtub capable of producing high velocity current having a predetermined pressure in the bathtub with a simple construction.

It is another object of the present invention to provide a high velocity current producing apparatus in a bathtub which enhances operability, functional property and safety without narrowing the space in the bathroom.

According to the present invention, the high velocity current is produced in the bathtub by connecting a pump to a circulation passage for circulating hot water in the bath through components outside the bathtub so that hot water sucked from the bathtub to the circulation passage is pressurized and supplied to the bathtub, and the high velocity current can be used for massaging the body of a bather.

To achieve the above object, the high velocity current producing apparatus in a bathtub according to a first aspect of the present invention comprises a bathtub for storing hot water therein, a connection body having a first suction section for drawing the hot water in the bathtub and a first discharge section for discharging the hot water from the outside of the bathtub to the inside of the bathtub, a circulation passage connected with the connection body and disposed between the first suction section and the discharge section for circulating the hot water, and a pump provided in the circulation passage for pressurizing the hot water in the bathtub that is drawn from the suction section and supplying the pressurized hot water to the discharge section, wherein high velocity current is supplied from the discharge section to the inside of the bathtub by the hot water in the bathtub.

With such a construction, the hot water in the bathtub can be circulated at high velocity from the suction section to the discharge section through the circulation passage, and the high velocity current can be produced in the bathtub from the discharge section. The high velocity current can be arbitrarily adjusted by switching the capacity of a pump or changing the opening area of the discharge section or the suction section. It is expected that a bather can apply the thus produced high velocity current to his or her body to obtain an appropriate massaging effect. Further, the temperature of hot water in the bathtub can be set to a desired temperature by heating or additionally heating water so that more efficient massaging effect together with a bathing effect can be expected. Further, it is not necessary to install a conventional equipment in the bathroom.

The high velocity current producing apparatus in a bathtub according to a second aspect of the present invention is characterized in that the discharge section of the first aspect of the present invention includes a discharge unit detachable therefrom for guiding the high velocity current from the discharge section to a given position. Since the discharge unit is provided on the discharge section, the high velocity current produced in the discharge section can be guided to a desired position. In the discharge unit, in addition to the stimulus and friction applied to a bather's body caused by the high velocity current produced in the bathtub, the bather can apply the high velocity current to a desired portion of his or her skin so that high pressure caused by the high velocity current is obtained, leading to more efficient massaging effect.

The high velocity current producing apparatus in a bathtub according to a third aspect of the present invention is characterized in that air introduction means is connected with the circulation passage or the connection body of the first aspect of the present invention, thereby producing air bubble current by the high velocity current. When such an introduction means is connected, air can be mixed with the high velocity current produced in the circulation passage or connection body, thereby producing high velocity air bubble current.

The high velocity current producing apparatus in a bathtub according to a fourth aspect of the present invention is characterized in that a closing valve for switching the introduction of air is provided on the air introduction means of the third aspect of the invention that is connected with the circulation passage or the connection body. The provision of such a closing valve allows a bather to select the introduction of air.

The high velocity current producing apparatus in a bathtub according to a fifth aspect of the present invention is characterized in that the discharge unit of the second aspect of the present invention has a nozzle for changing the velocity and direction of water current. Although a desired nozzle can be provided on the discharge unit, this nozzle allows the high velocity current to have varied velocity and direction thereof. As a result, a bather can obtain a desired high velocity current.

The high velocity current producing apparatus in a bathtub according to a sixth aspect of the present invention is characterized in that the discharge unit of the second aspect of the invention has a nozzle provided with a first discharge port and second plurality of discharge ports that are closable when operated. The nozzle having a plurality of discharge ports can be attached to the discharge unit. The provision of such plurality of discharge ports can obtain a high velocity current that is changed variously in the amount and direction of water by the selection thereof.

The high velocity current producing apparatus in a bathtub according to a seventh aspect of the present invention is characterized in that the discharge unit of the second aspect of the present invention has a nozzle at the tip end of a flexible hose connected with the discharge port of the connection body. As the discharge unit, it is possible to use an arbitrary shape, and also possible to use the flexible hose provided with a nozzle at the tip end thereof so that a bather can easily change the direction of the high velocity current.

The high velocity current producing apparatus in a bathtub according to an eighth aspect of the present invention is characterized in further comprising control means for driving the pump, driving the closing valve to be opened or closed, and controlling the operating time of the pump. The closing valve for selecting the driving of the pump and the introduction of air is controlled by the control means. This control means can control the operation time of the pump, thereby enhancing safety of a bather.

The high velocity current producing apparatus in a bathtub according to a ninth aspect of the present invention is characterized in that the control means of the eighth aspect of the invention for driving the pump and operating time of the pump is installed outside the bath room, and further comprising a remote control section installed in the vicinity of the bathtub in the bathroom for operating control means and switching the closing operation of the closing valve. With such a construction, the remote control section alone is provided, for example, on the wall of the bathroom so that a bather can select a desired operation mode by operating the remote control section. Further, since the control means is provided outside the bathroom, the space inside the bathroom is the same as that before the control means is provided, and hence the space of the bathroom is not narrowed.

The high velocity current producing apparatus in a bathtub according to a tenth aspect of the present invention is characterized in further comprising a high velocity current producing unit that incorporates therein the circulation passage, the pump and the air introduction means and is installed outside the bathroom. The high velocity current producing unit is a single apparatus in which the circulation passage, the pump and the air introduction means respectively connected with the connection body of the bathtub are incorporated.

The high velocity current producing apparatus in a bathtub according to an eleventh aspect of the present invention is characterized in that the connection body of the first aspect of the present invention is shared with a hot water producing unit or a water heating unit connected with the bathtub. That is, the connection body provided in the bathtub can be shared with a so-called circulation member that has been conventionally used. Such a sharing does not narrow space or area of the bathtub and is advantageous in working thereof. Further, when the hot water producing unit or water heating unit is connected with the connection body, the temperature of hot water in the bathtub can be controlled to set to a desired temperature in addition to the production of high velocity current. A bather can promote his or her health caused by the bathing effect as well as the high velocity current.

The objects, features and effects of the present invention can be clearer with reference to the detailed description of the working example and embodiments set forth hereunder, and the attached drawings.

PREFERRED EMBODIMENT OF THE INVENTION

Figure 1:
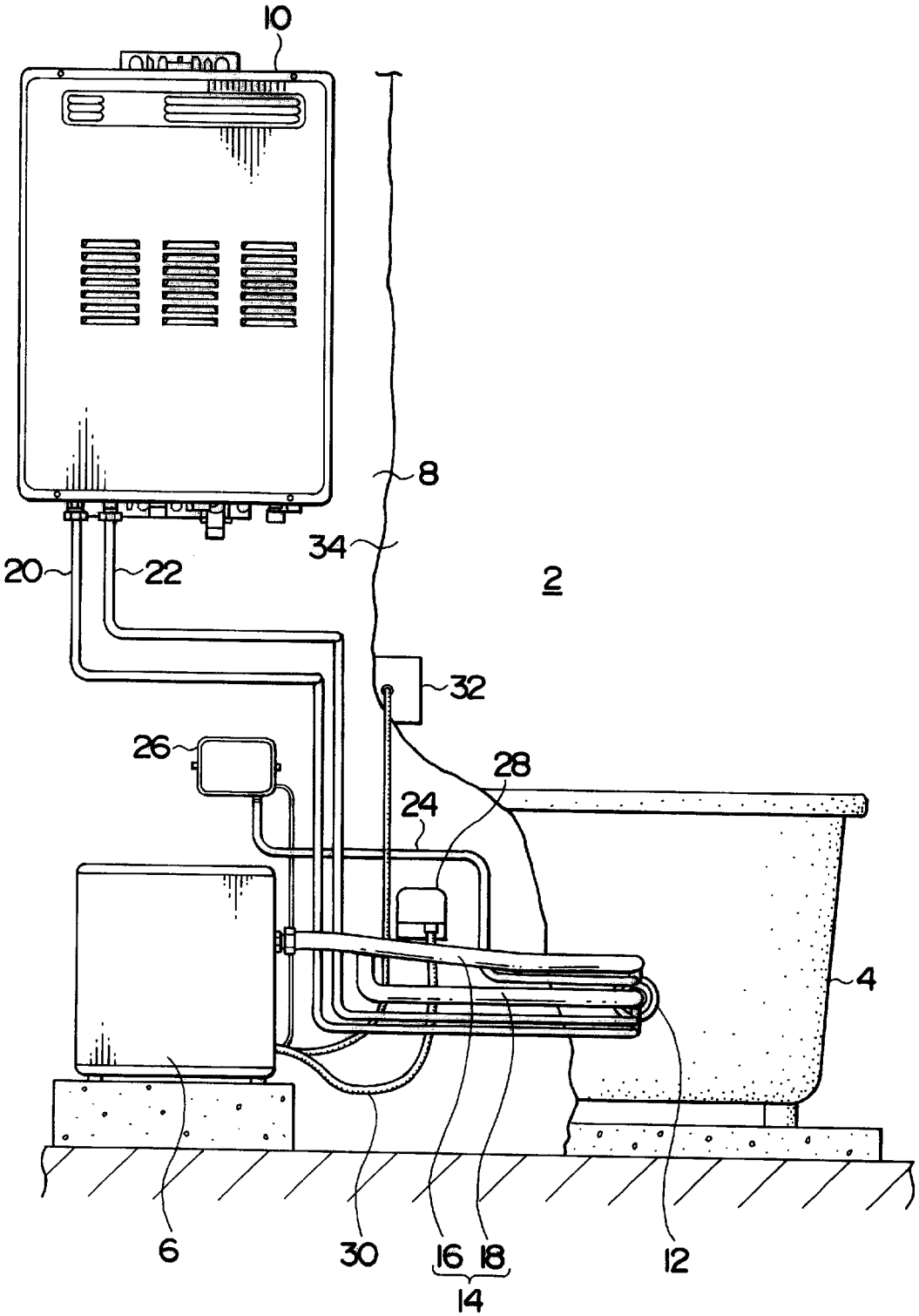
FIG. 1 is a view for explaining a high velocity current producing apparatus in a bathtub according to an embodiment of the present invention.

A bathtub 4 is installed inside a bath room 2 to store hot water 3 therein and a water current or jet producing unit (hereinafter referred to as high velocity current producing unit) 6 is installed outside the bath room 2. A water heating and additional heating unit 10 (hereinafter referred to simply as water heating unit 10) serving as a hot water producing unit or water heating unit is installed on an outer wall 8 of a house. A connector 12 serving as a connection body is attached to a side wall of the bathtub 4, and pipes 16 and 18 constituting a circulation passage 14 are connected between the connector 12 and the high velocity current producing unit 6. Pipes 20 and 22 are connected between the connector 12 and the water heating unit 10. An air introduction pipe 24 serving as air introducing means is connected with the connector 12 and it has an air valve 26 that serves as a closing valve and is attached to the outer wall 8.

Figure 2:
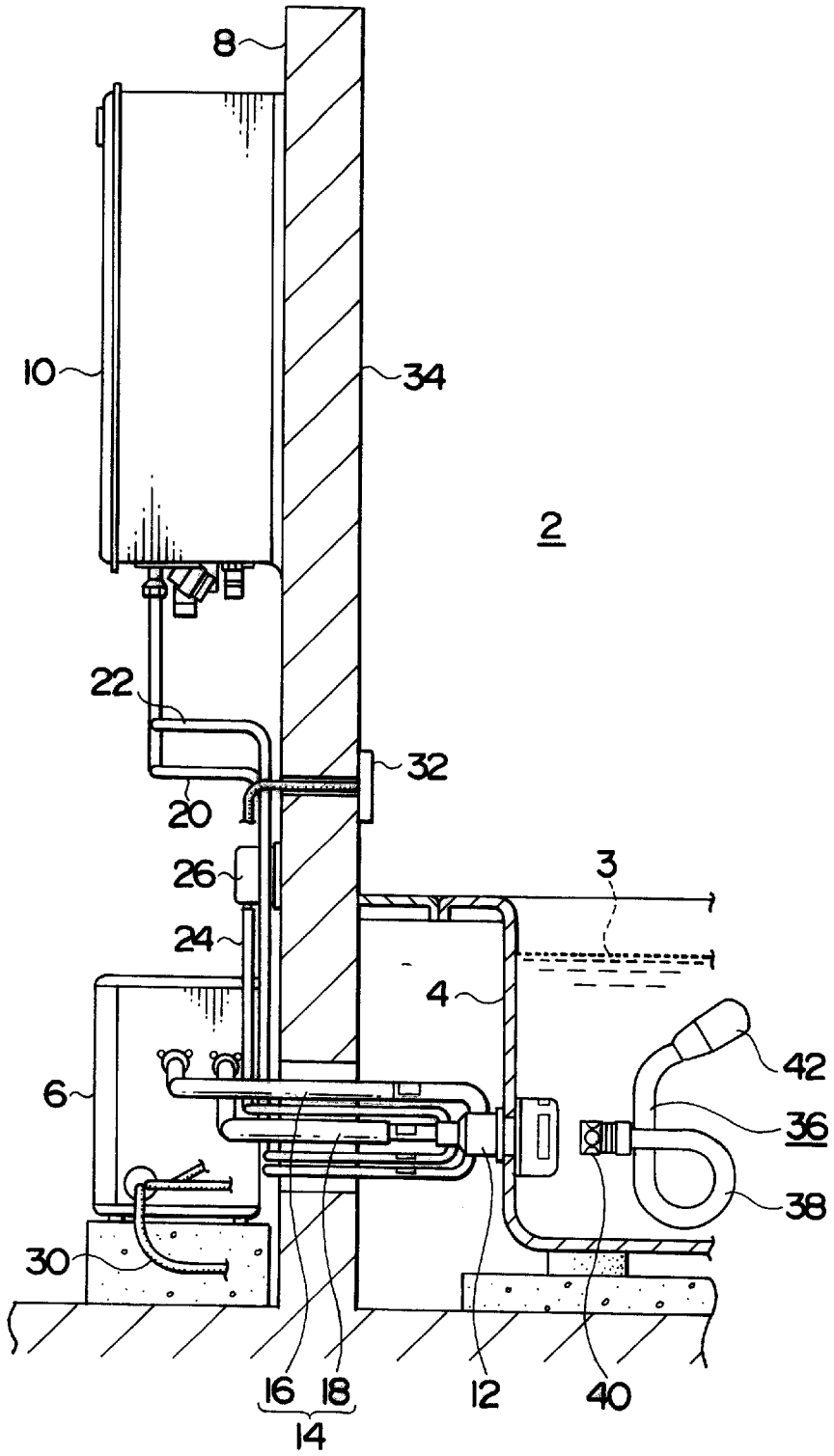
FIG. 2 is a view for explaining the high velocity current producing apparatus in a bathtub according to the embodiment of the present invention.

Power is applied to the high velocity current producing unit 6 through a wise 30 connected with a wall outlet 28 provided on the outer wall 8. A remote control section 32 is provided on the high velocity current producing unit 6 and it is disposed close to the bathtub 4, i.e., on a wall 34 of the bath room 2. A discharge unit 36 is provided inside the bathtub 4 and it is detachable to the connector 12 (FIG. 2). The discharge unit 36 comprises a flexible hose 38, a connection part 40 at one end thereof and a nozzle 42 at the other end thereof.

Figure 3:
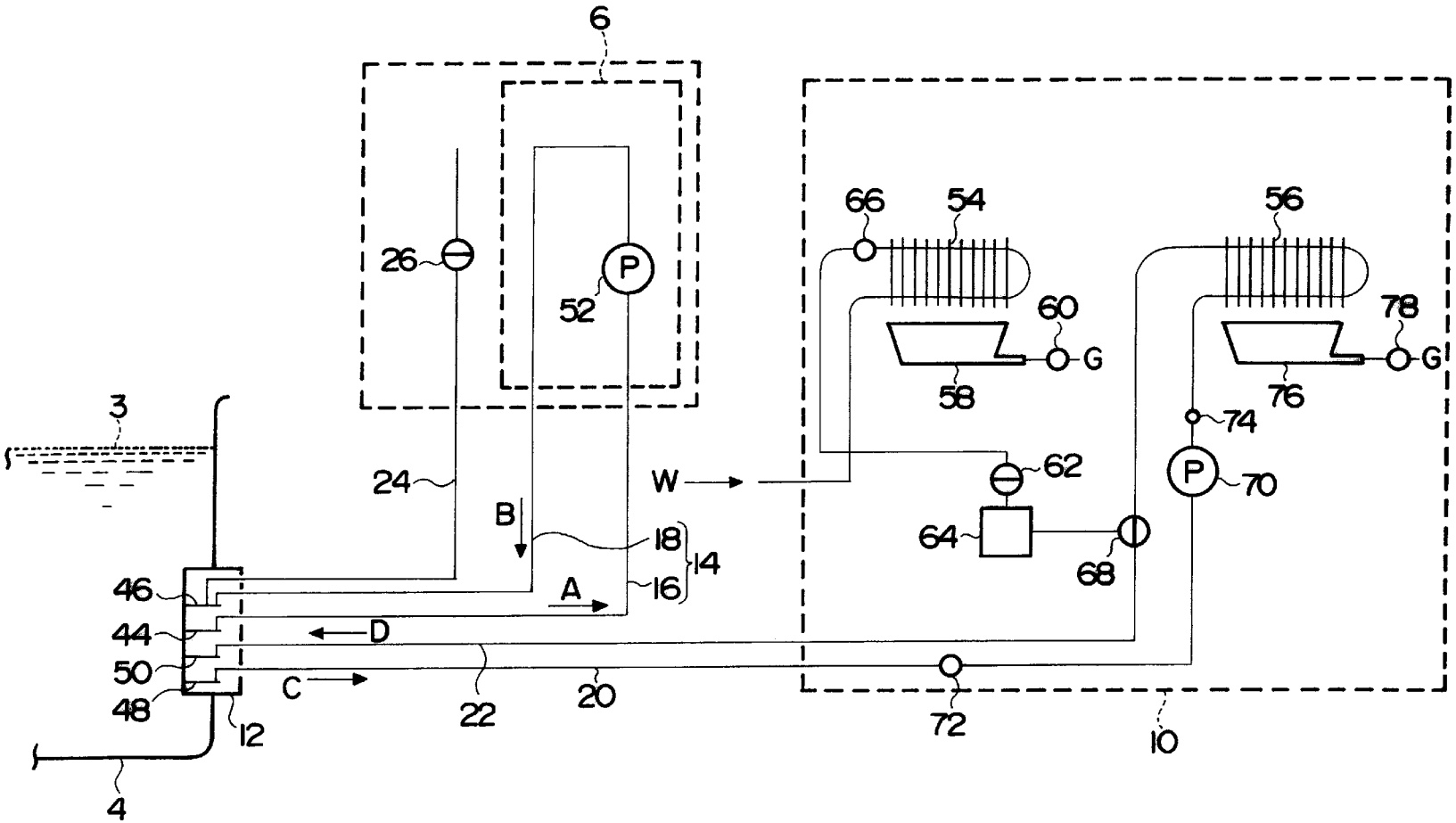
FIG. 3 is a view showing a piping system of the high velocity current producing apparatus in a bathtub.

FIG. 3 shows an example of a hot water system:

The connector 12 attached to the bathtub 4 has a first suction section 44 and a first discharge section 46 respectively constituting with the circulation passage 14, and also has a second suction section 48 and a second discharge section 50 respectively connected with the water heating unit 10. The pipe 16 is connected with the first suction section 44 and the pipe 18 is connected with the first discharge section 46 while the circulation passage 14 is formed between the first suction section 44 and the first discharge section 46, and a pump 52 is interposed between the pipe 16 and pipe 18 constituting the circulation passage 14. In this embodiment, although the high velocity current producing unit 6 comprises the pump 52 and a control section (not shown in FIG. 3 but shown in FIG. 4), it may include the air introduction pipe 24 and the air valve 26. Denoted by the arrows A and B show the directions of high speed water current.

The pipe 20 at the side of the water heating unit 10 is connected with the second suction section 48 and the pipe 22 is connected with the second discharge section 50. The water heating unit 10 has a first heat exchanger 54 for supplying hot water (hereinafter simply referred to as first heat exchanger 54) and a second heat exchanger 56 for additionally heating water (hereinafter simply referred to as second heat exchanger 56) wherein service water W is supplied to the first heat exchanger 54. A fuel gas G is supplied to the burner 58 via a proportional valve 60, and the first heat exchanger 54 is heated by the combustion of the fuel gas G by a burner 58. The service water W that is heated by heat exchange is supplied to a hopper 64 via valve 62. The temperature of the service water W heated by heat exchange is detected by a temperature sensor 66 provided at the outlet side of the first heat exchanger 54. The hopper 64 is means for separating the service water W and the bathtub 4 side and the service water W flowing out from the hopper 64 is supplied to the pipe 22 via a three-way valve 68.

Water in the bathtub 4 is supplied to the second heat exchanger 56 through the pipe 20, and a pump 70 for pressurizing water is provided on the pipe 20. The temperature of circulating water is detected by a temperature sensor 72 and the presence of water current is detected by a water current sensor 74. The fuel gas G is supplied to the burner 76 via a closing valve 78 and the second heat exchanger 56 is heated by the combustion on the fuel gas G by a burner 76. Denoted by the arrows C and D show directions of water current of the hot water 3 in the bathtub 4.

Figure 4:
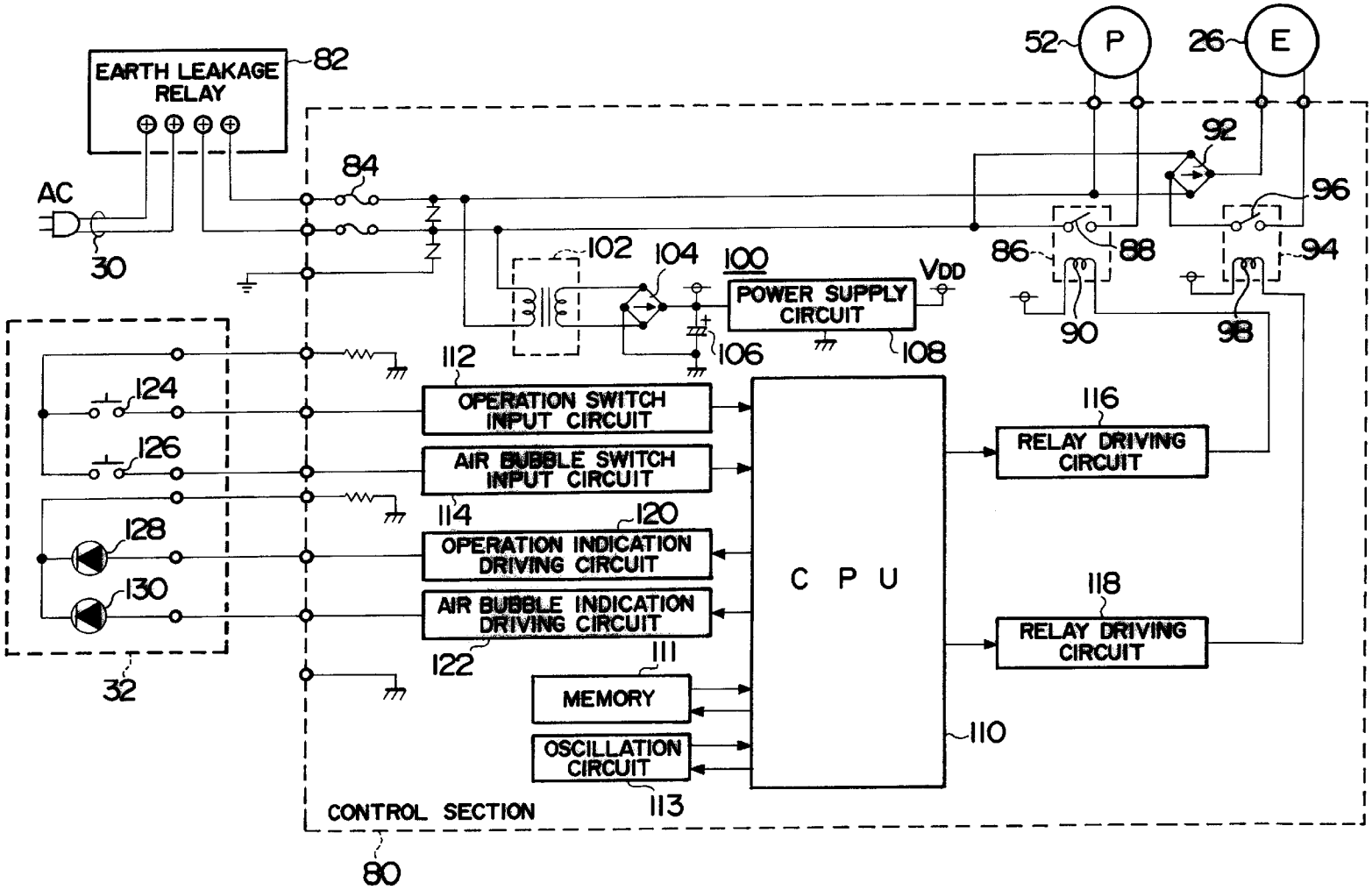
FIG. 4 is a block diagram showing a control system of the high velocity current producing apparatus in a bathtub.

FIG. 4 is an example of the control system of the high velocity current producing apparatus in bath.

The control system has a control section 80 and the remote control section 32. The pump 52 can be driven by a commercial ac power. Accordingly, the commercial ac power or voltage is applied to the pump 52 via an earth leakage relay 82 and fuses 84 in the control section 80. A contact 88 of a relay 86 is interposed in an ac voltage application circuit, wherein an excitation coil 90 is excited to close the contact 88, thereby applying the ac voltage to the pump 52.

Meanwhile, the air valve 26 is driven by a dc voltage. When a rectifier 92 rectifies the ac voltage to produce a dc voltage that is applied to the air valve 26. A contact 96 of a relay 94 is provided at the output side of the rectifier 92. An excitation coil 98 is excited to close the contact 96, thereby applying the rectified dc voltage to the air valve 26.

A stabilized power supply unit 100 is provided at the control section 80 and it comprises a transformer 102 which lowers the commercial ac voltage upon reception of it, a rectifier 104 which rectifies the lowered ac voltage, a capacitor 106 which smoothes the voltage and a stabilized power supply circuit 108 which changes the ac voltage to a dc voltage $V_{DD}$ having a given value.

In the control section 80, there are provided a CPU 110 serving as an operation control element, a memory 111, an oscillation circuit 113, an operation switch input circuit 112, an air bubble switch input circuit 114, relay driving circuits 116, 118, an operation indication driving circuit 120, an air bubble indication driving circuit 122 and so forth. The oscillation circuit 113 produces a clock signal and the memory 111 stores therein necessary data and a control program. These circuits of the control section 80 as set forth above are driven by the output of the stabilized power supply circuit 108.

In the remote control section 32, there are provided an operation switch 124, an air bubble producing switch 126, a light emitting diode 128 (LED) serving as an operation indication unit and a light emitting diode 130 (LED) serving as an air bubble indication unit.

In the control section 80, when the operation switch 124 is closed, an input voltage indicating the closing of the operation switch 124 is applied to the operation switch input circuit 112 so that an operation instruction is supplied from the operation switch input circuit 112 to the CPU 110. As a result, an excitation current flows from the relay driving circuit 116 to the excitation coil 90 to close the contact 88 so that the ac voltage is applied to the pump 52, thereby producing the high velocity current. At this time, an indication output is outputted from the CPU 110 to the operation indication driving circuit 120, then the operation indication driving circuit 120 issues a driving output to the light emitting diode 128 so that the light emitting diode 128 is illuminated by the driving output.

When the air bubble producing switch 126 is closed, an input voltage indicating the closing of the air bubble producing switch 126 is applied to the air bubble switch input circuit 114 so that an operation instruction is supplied to the CPU 110. As a result, an excitation current flows from the relay driving circuit 118 to the excitation coil 98 to close the contact 96 so that the dc voltage is applied to the air valve 26, thereby producing the air bubble. At this time, an indication output is issued from the CPU 110 to the air bubble indication driving circuit 122 so that the light emitting diode 130 is illuminated by the output of the air bubble indication driving circuit 122.

Figure 5:
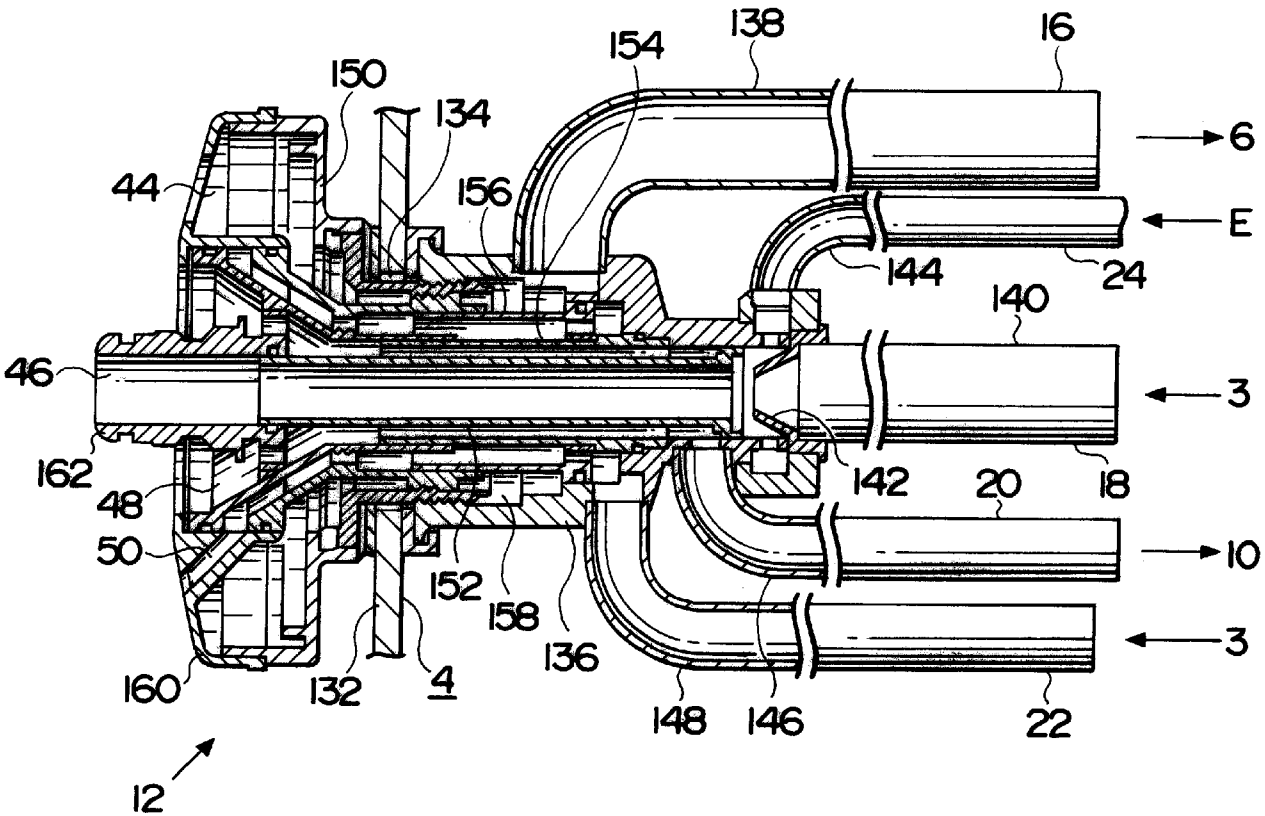
FIG. 5 is a sectional showing the construction of a connector of the high velocity current producing apparatus in a bathtub.
Figure 6:
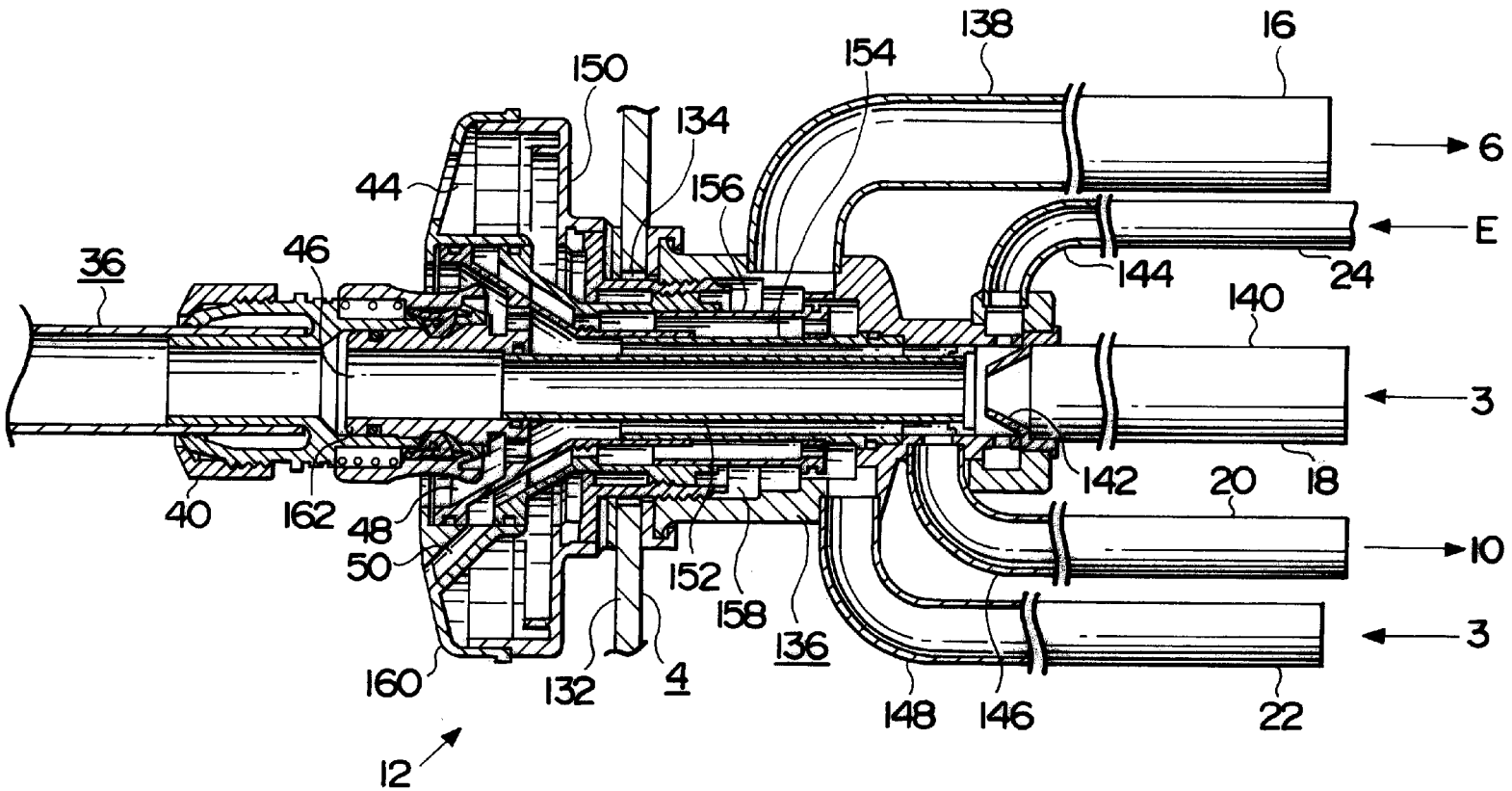
FIG. 6 is a sectional showing the construction of the connector of the high velocity current producing apparatus in a bathtub.
Figure 7:
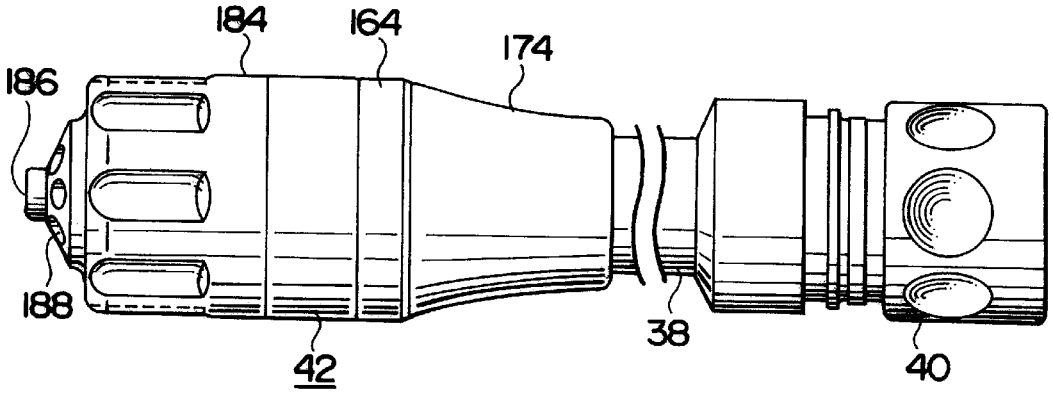
FIG. 7 is a side view showing a discharge unit.
Figure 8:
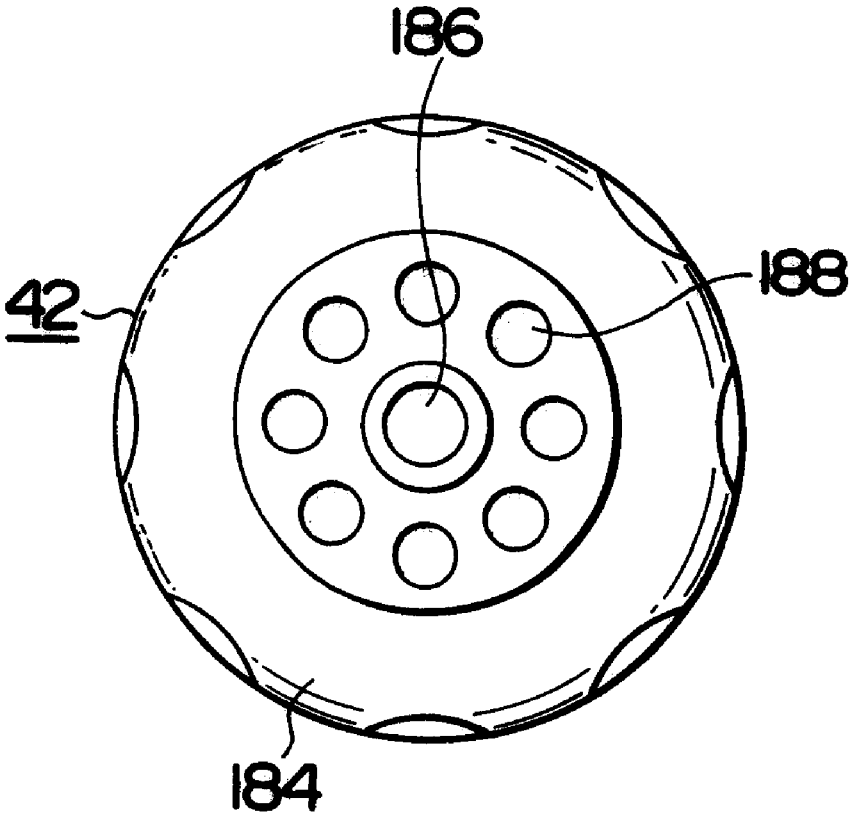
FIG. 8 is a front view showing a nozzle surface of the discharge unit.

FIGS. 5 and 6 show the construction of the connector 12 and the connection between the connector 12 and the discharge unit 36.

The connector 12 penetrates the bathtub 4 and allows the pipes 16, 18, 20 and 22 to communicate with the inside of the bathtub 4, and it is connected with the air introduction pipe 24 to give air current to high velocity current. Accordingly, the connector 12 serves as fixing means for fixing these pipes to the inside and the outside of the bathtub 4 and has the first and second suction sections 44 and 48 and the first and the second discharge sections 46 and 50 serving as passages for individually communicating with the pipes 16 and 18 and the pipes 20 and 22.

Described next is the concrete construction of the connector 12. A through hole 134 is provided on the side wall 132 of the bathtub 4 for allowing the connector 12 to pass therethrough, and a connection body 136 is provided on the outer surface of the side wall 132. A connection part 138 for communicating with the first suction section 44 is fixed to the outer surface of the connection body 136 and the pipe 16 is connected with the connection part 138. A connection part 140 is connected with the rear portion of the connection body 136 and a conical small diameter part 142 is formed on the tip end of the connection part 140. A connection part 144 is connected with the periphery of the small diameter part 142 for connecting with the air introduction pipe 24.

In the connection body 136, there are provided connection parts 146 and 148 for independently connecting with the pipes 20 and 22 at the side of the water heating unit 10 wherein the connection part 146 communicates with the second suction section 48 and the connection part 148 communicates with the second discharge section 50.

A passage separation member 150 serving as fluid passage separation means and fixing means is fixed to the connection body 136 by screws via the through hole 134 at the inner side of the side wall 132 of the bathtub 4, whereby the side wall 132 is fixed while it is clamped between the connection body 136 and the passage separation member 150 while it is clamped therebetween.

A discharge pipe 152 is fixed to the center of the passage separation member 150 while penetrating the side wall 132. A suction pipe 154 communicating with the second suction section 48 is provided around the discharge pipe 152 and a discharge pipe 156 is provided around the suction pipe 154, that is, the suction pipe 154 and discharge pipe 156 are concentrically provided around the discharge pipe 152. A suction space 158 communicating with the first suction section 44 is formed around the discharge pipe 156.

Provided at the front surface of the passage separation member 150 is a cover 160 having passages corresponding to the discharge pipe 152, the suction pipe 154, the discharge pipe 156 and the suction space 158. A connection part 162 is provided at the center of the cover 160 for connecting with the discharge unit 36.

As shown in FIG. 6, the connection part 40 of the discharge unit 36 is structured to retain the connection part 162 of the connector 12 so as to cover it so that the connection part 40 and the connection part 162 are connected with each other with the connecting force to stand the high velocity current.

FIGS. 7 to 12 show construction of the nozzle 42 of the discharge unit 36.

The nozzle 42 is fixed to the tip end of the flexible hose 38 and a connection pipe 166 serving as fixing means is provided at the center of a nozzle body 164. The connection pipe 166 is firmly fixed to the nozzle body 164 by a screw part 170 while contacting an O ring at the tip end side. A retainer part 172 is provided on the peripheral surface of the rear part of the connection pipe 166 and it is covered with and fixed to the flexible hose 38. The peripheral surface of the flexible hose 38 is covered with and fixed to a cylindrical fastening part 174 having a small diameter screw part 176 which is fastened by an inner screw part of the nozzle body 164, whereby the flexible hose 38 is firmly fixed to the connection pipe 166 while it is retained by the retainer part 172.

A rotary ring 180 is attached to the nozzle body 164 while it is prevented from coming off from the nozzle body 164 by a C ring 178 serving as retaining means. A small diameter screw 182 is formed on the rotary ring 180. A discharge opening part 184 having a cap shape is fixed to the small diameter screw 182 while retained by the inner screw and it is rotatably supported by the nozzle body 164 integrally with the rotary ring 180. The discharge opening part 184 has a first discharge port 186 provided at the center thereof and a plurality of second discharge ports 188 surrounding the first discharge port 186. A small diameter part 190 at the tip end side of the nozzle body 164 protrudes into the inner space of the discharge opening part 184, and a valve body 192 is provided in the inner space of the discharge opening part 184 to be slidable forward backward therein. The valve body 192 engages the small diameter part 190 and is retained by the inner wall of the discharge opening part 184 at the outer peripheral surface by a screw part 194. The valve body 192 has a through hole 196 at the center thereof corresponding to the first discharge port 186 and a closing face 198 for closing the second discharge ports 188 at the outer periphery thereof.

Figure 9:
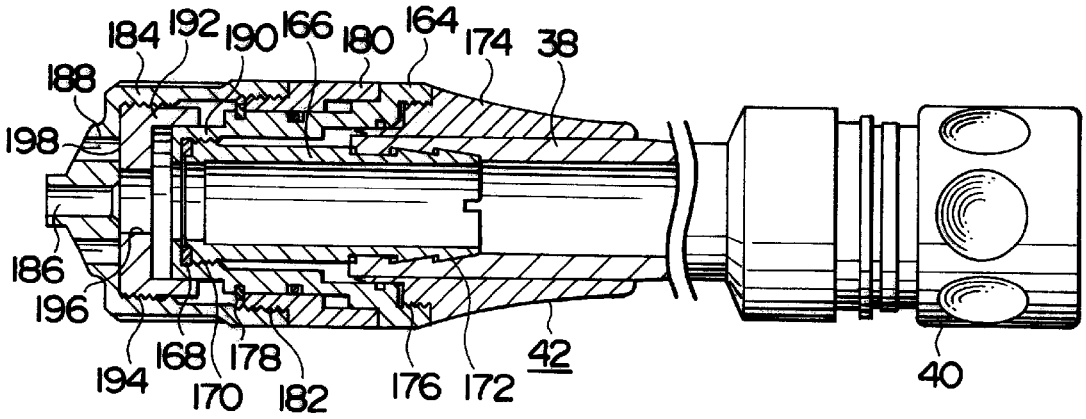
FIG. 9 is a partial sectional view showing the discharge unit.
Figure 10:
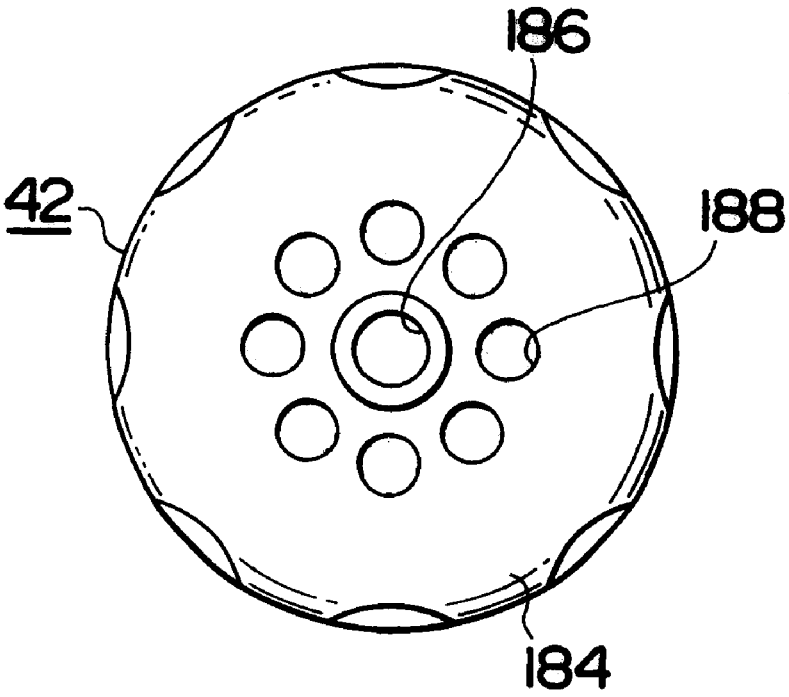
FIG. 10 is a front view showing the nozzle surface of the discharge unit.

FIGS. 9 and 10 show a state where the second discharge ports 188 is closed by the valve body 192 wherein the high velocity current is discharged from the central first discharge port 186 alone. Broken lines shown in the second discharge ports 188 show the closed state to obtain high velocity current of small diameter.

Figure 11:
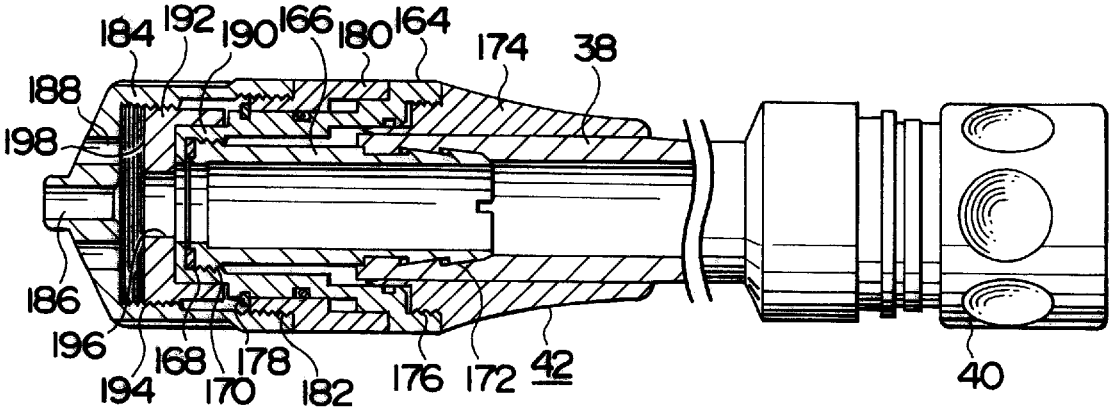
FIG. 11 is a sectional view showing the discharge unit.
Figure 12:
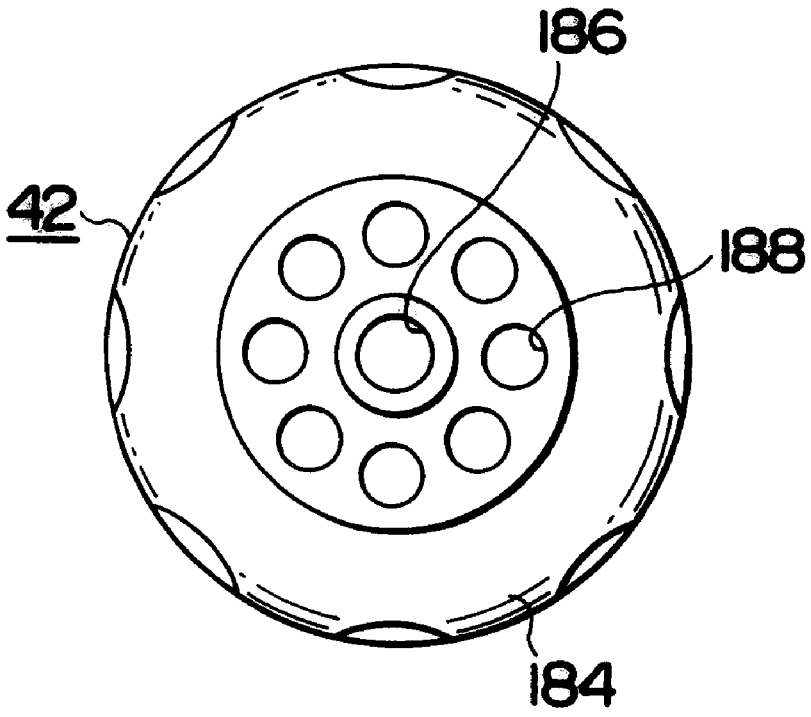
FIG. 12 is a front view showing the nozzle surface of the discharge unit.
Figure 13:
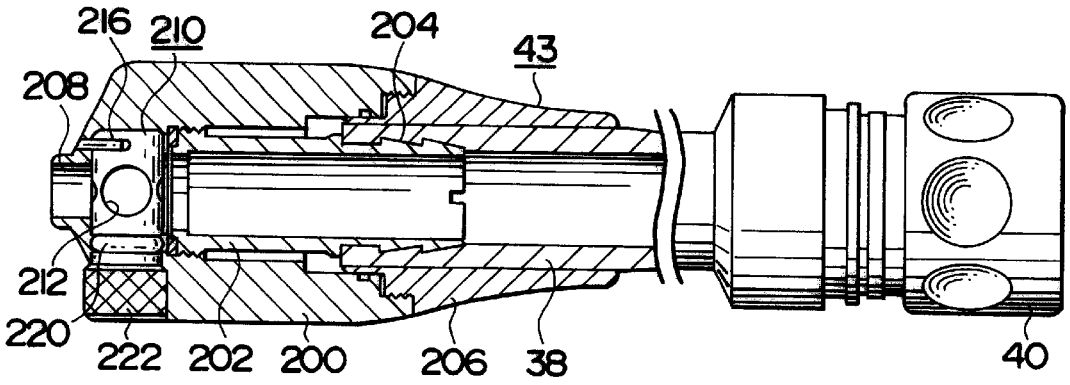
FIG. 13 is a partial sectional view showing another discharge unit according to another working example.
Figure 14:
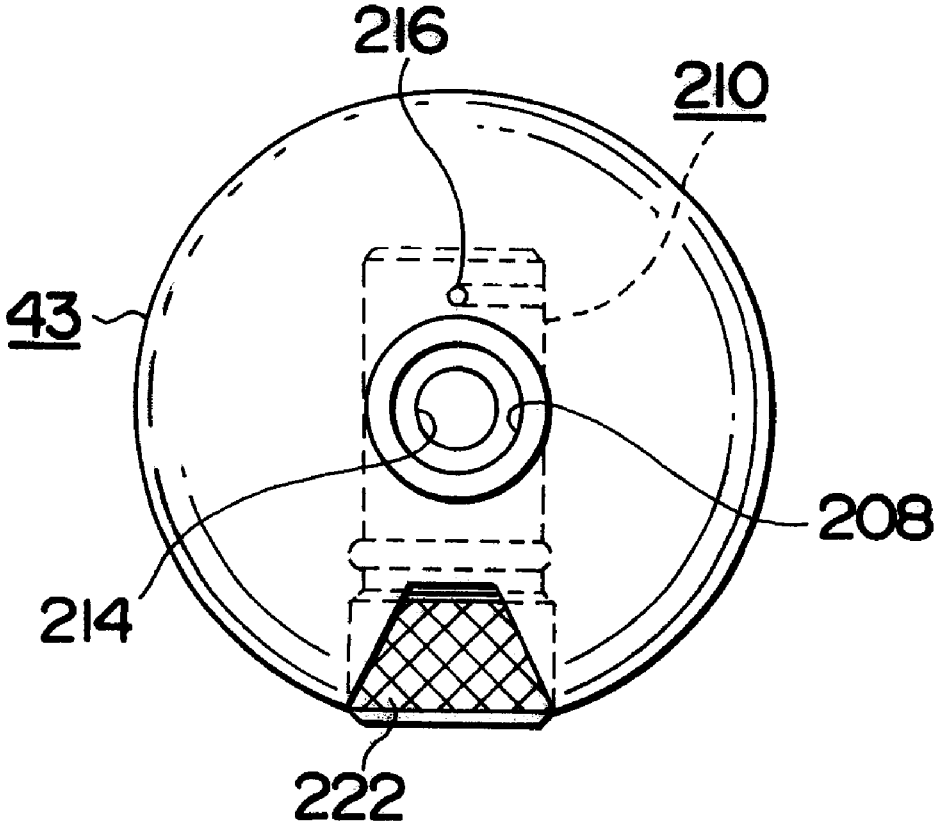
FIG. 14 is a front view showing a nozzle surface of the discharge unit shown in FIG. 13.
Figure 15:
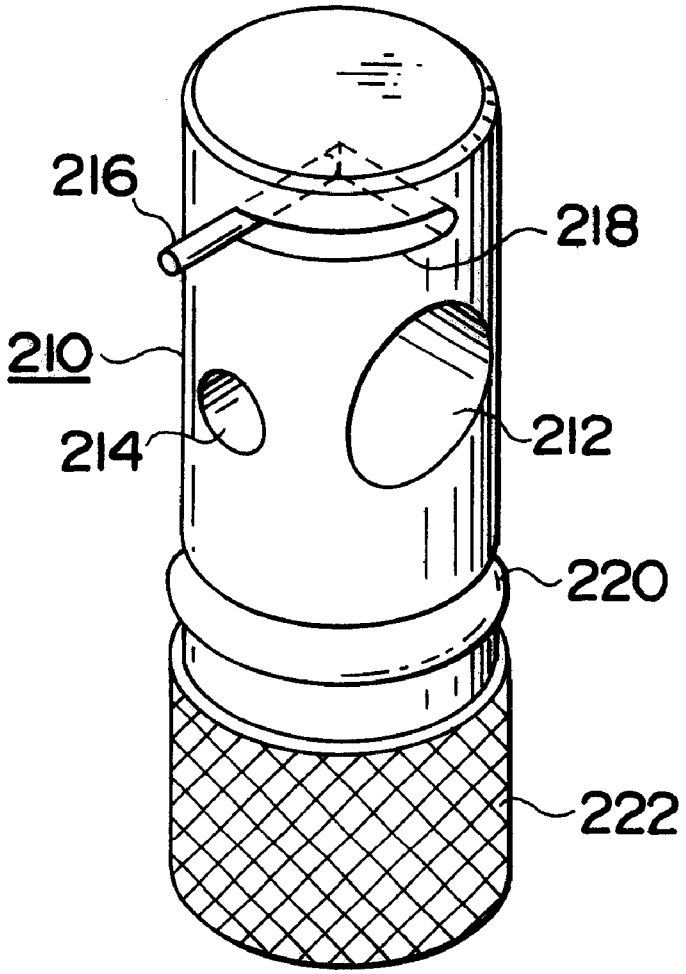
FIG. 15 is a perspective view showing a water current adjusting valve body of the nozzle shown in FIG. 14.
Figure 16:
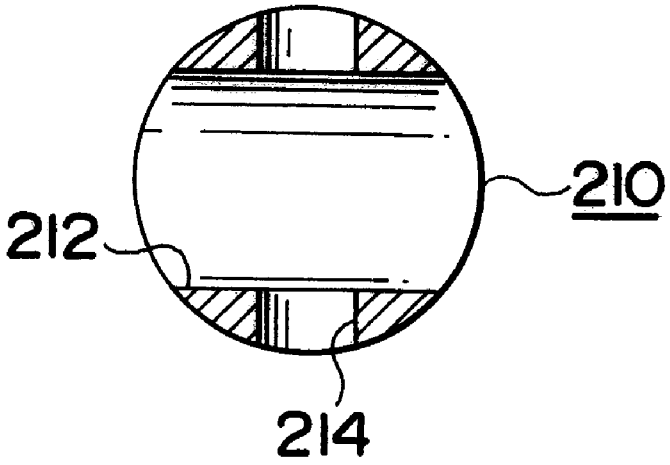
FIG. 16 is a lateral sectional view of a water passage hole part of the water current adjusting valve body shown in FIG. 15.

When the discharge opening part 184 is turned while holding the nozzle 42, the valve body 192 is slid forward and backward in the direction of the turning thereof, wherein when the valve body 192 is slid or moved backward as shown in FIG. 11, the closing face 198 of the valve body 192 is moved away from the second discharge ports 188 to open the second discharge ports 188. FIG. 12 shows a state where the second discharge ports 188 is opened, wherein high velocity current is obtained through the first and second discharge ports 186 and 188, and hence the high velocity current becomes larger in diameter than that shown in FIG. 10. In such a manner, a bather can obtain high velocity current of predetermined diameter by turning the discharge opening part 184 so that the stimulus of pressurized water corresponding to the diameter of the high velocity current can be applied to a skin of the bather.

As a result, the hot water 3 in the bathtub 4 can be drawn from the bathtub 4 to the circulation passage 14 so that the hot water 3 can be pressurized and supplied to the bathtub 4 via the connector 12. That is, the high velocity current is applied to the hot water 3 in the bathtub 4 so that the bather can soak in the high velocity current. Since the hot water 3 has an appropriate temperature and the high velocity water applies stimulus to the skin, leading to the expectation of massage effect caused by the high heating thermal effect and the stimulus applied to the skin by the high velocity current. If the bather connects the discharge unit 36 with the connector 12, and operates the discharge unit 36, the bather can apply high velocity water to given portions of the skin. As a result, the bather enjoys appropriate stimulus of pressurized water current, and hence the bather can enjoy a massaging effect together with a bathing effect.

Next, FIGS. 13 to 16 show the construction of the nozzle 43 of another type. The nozzle 43 has a nozzle body 200 and a connecting pipe 202 fixed to the inside of the nozzle body 200 by a screw. The connecting pipe 202 has a retaining part 204 that is covered with the flexible hose 38, which are connected with each other while they are fastened by a cylindrical fastening part 206. Such a fixing structure is the same as the nozzle 42 shown in FIG. 7.

The nozzle 43 has a single discharge port 208 at the tip end and a valve body 210 for changing the amount of water to pass through the discharge port 208. The valve body 210 is fixed to the discharge port 208 to cross at right angles therewith and has a cylindrical shape shown in FIG. 15. The valve body 210 has a large diameter water passage hole 212 and a small diameter water passage hole 214 that crosses at right angles with the large diameter water passage hole 212 as shown in sectional view of FIG. 16. In the valve body 210, there is formed a fan-shaped groove 218 that has an angle of 90° and retains a pin 216 for supporting the valve body 210 so that the pin 216 turns within the angle of 90° of the fan-shaped groove 218. The fan-shaped groove 218 restricts the turning range of the valve body 210. An O ring 220 is attached to the middle portion of the valve body 210 and a turning operation part 222 is formed at the lower portion of the valve body 210 by knurling it.

The valve body 210 is disposed at the inside of the discharge port 208 of the nozzle body 200 in the direction to cross at right angles with the discharge port 208, and it is attached to the nozzle body 200 by the pin 216 provided in the vicinity of the discharge port 208 to be turned with and prevented from coming off from the nozzle body 200.

Accordingly, if the turning operation part 222 that is exposed on the front of the nozzle 43 is turned, the large diameter water passage hole 212 and small diameter water passage hole 214 of the valve body 210 are switched over to fit to the discharge port 208. That is, the bather can enjoy the high velocity current of predetermined diameter by operating the turning operation part 222 because it is possible to obtain the high velocity current of large diameter in the case that high velocity current flows through the large diameter water passage hole 212, that of small diameter in the case that it flows through the small diameter water passage hole 214, and that of irregular diameter in the case that it flows through the passage hole having the middle diameter between the large diameter water passage hole 212 and the small diameter water passage hole 214.

Although in the embodiments set forth above, the connector 12 is shared by the connector 12 and the water heating unit 10, the high velocity current producing unit 6 and the water heating unit 10 may be respectively connected to the bathtub 4 by individual and separated connecting parts.

Further, the nozzle 42 to be fixed to the discharge unit 36 may be arbitrary and the discharge ports 186, 188, and 208 provided at the tip end thereof may be arbitrarily set in the direction thereof.

The present invention having the construction set forth above has the following effects.

a. It is possible to produce a high velocity current in the bathtub with a simple structure using hot water in the bathtub, leading to the massaging effect.

b. Since there is not provided equipment to produce water current in the bath room, an effective area in the bath room is not narrowed and a power supply system can be installed outside the bath room, and hence the high velocity current producing apparatus of the present invention is excellent in safety and function.

c. The high velocity current produced in the bath room allows the discharge unit to detachably attach to the connection body, and allows the discharge unit to apply the pressurized water current to given positions of a bather, leading to a more efficient massaging effect.

d. Since air current can be selectively mixed with the high velocity current using air introduction means, the high velocity air bubble current can be easily produced.

e. Necessary operations can be made in the bath room, and hence the high velocity current producing apparatus is excellent in operability.

f. The high velocity current can be set arbitrarily in the direction and velocity thereof.

Although the present invention is described in construction, function and effect using working examples and embodiments set forth above, the scope of the present invention is not limited to these working examples and embodiments. In other words, the present invention includes all the construction expected by a person skilled in the art such as construction and modifications that are conjectured from the disclosed in the specification beyond the objects and the embodiments of the present invention.

What is claimed is:

1. A high velocity current producing apparatus for producing high velocity current in a bathtub installed in a bathroom using hot water inside the bathtub comprising:

a water heating and additional heating unit for heating service water to produce hot water or heating the hot water upon reception of the hot water from the inside of the bathtub, wherein the water heating and additional heating unit has a heat exchanger for hot-water supply for heating the service water by combustion heat of a burner and a heat exchanger for additionally heating water inside the bathtub by combustion heat of the burner;

a first circulating passage for circulating water inside the bathtub to the heat exchanger for additionally heating water, wherein the first circulating passage having a first pipe through which water or hot water inside the bathtub flows into the heat exchanger for additionally heating water and a second pipe through which the hot water obtained by heating by the heat exchanger for additionally heating water is returned to the bathtub, and a third pipe through which the hot water from the heat exchanger for hot-water supply is supplied is connected to the second pipe, and a three-way valve provided on the connection portion between the second and third pipe for allowing the hot water to flow from the heat exchanger for hot-water supply into the bathtub through the second pipe;

a first pump installed on the first circulating passage for forcibly circulating the hot water inside the bathtub in the first circulating passage;

a high velocity current producing unit for producing high velocity current in the bathtub using the hot water obtained by the water heating and additional heating unit, the first circulating passage and the pump, wherein the high velocity current producing unit is installed outside the bathroom and having a second circulating passage for circulating the hot water inside the bathtub and a second pump for forcibly circulating the hot water inside the bathtub in the second circulating passage to produce high velocity current from the outside of the bathroom to the inside of the bathtub, and wherein the second circulating passage having a pipe for introducing the hot water inside the bathtub into the second pump and a pipe for introducing hot water pressurized by the second pump into the bathtub;

an air introduction pipe for taking in air from outside the bathroom and introducing the air into the bathtub of the bathroom, wherein the air introduction pipe has a closing valve for changing over air to be taken in the air introduction pipe:

a connection body for connecting the first circulating passage of the water heating and additional heating unit and the second circulating passage of the high velocity current producing unit with the bathtub, wherein the connection body is fixed to a wall surface of the bathtub and having a first suction section, a second suction section, a first discharge section and a second discharge section, and wherein the first suction section is connected to the pipe of the second circulating passage for introducing the hot water inside the bathtub from the bathtub into the second pump, and the first discharge section is connected to the pipe of the second circulating passage for flowing high velocity current of the hot water from the second pump of the second circulating passage to the bathtub and also connected to the air introduction pipe whereby air bubble current is produced in the high velocity current by air introduced through the air introduction pipe;

and wherein the second suction section is connected to the first pipe of the first circulating passage through which water inside the bathtub is introduced from the bathtub into the heat exchanger for additionally heating water of the water heating and additional heating unit, and the second discharge section is connected to the second pipe through which the hot water flows from the heat exchanger for additionally heating water to the bathtub;

a discharge unit removably attached to the first discharge section of the connection body, wherein the discharge unit has a connection section removably attached to the first discharge section, a flexible hose attached to the connection section at one end thereof, and a nozzle connected to the flexible hose at the other end thereof, whereby the discharge unit receives the high velocity current produced in the first discharge section at the connection section, thereby allowing the high velocity current to flow into the inside of the bathtub through the nozzle connected to the flexible hose, or receives the high velocity current together with the air bubble current at the connection section when the air bubble current is produced in the high velocity current, allowing the high velocity current together with the air bubble current to flow into the inside of the bathtub through the nozzle connected to the flexible hose;

the nozzle having a discharge port for discharging the high velocity current or the high velocity current with air bubbles, and adjustment means for adjusting the degree of opening of the discharge port, wherein the high velocity current or the high velocity current with air bubbles can be produced in the bathtub by a desired discharging volume;

control means installed outside the bathroom for supplying power to the second pump, switching over the closing valve, and generating an output when the high velocity current producing apparatus is operated or air bubbles are produced; and remote control means connected to the control means for instructing the operation of the high velocity current producing apparatus and the driving of the closing valve to the control means, wherein the remote control means is installed in the vicinity of the bathtub inside the bathroom and has an indication element for indicating an operation state or non-operation state of the high velocity current producing apparatus upon reception of the output from the control means and an indication element for indicating the production or non-production of the air bubbles upon reception of the output from the control means.

2. The high velocity current producing apparatus for producing high velocity current in a bathtub according to claim 1, wherein the nozzle changes magnitude and direction of flow velocity.

3. The high velocity current producing apparatus for producing high velocity current in a bathtub according to claim 1, wherein the nozzle includes a first discharge section and a second discharge section, and the second discharge section is openable and closable manually.

4. The high velocity current producing apparatus for producing high velocity current in a bathtub according to claim 1, wherein the control means drives the second pump, drives the closing valve to be opened or closed and controls the operation time of the second pump.

5. The high velocity current producing apparatus for producing high velocity current in a bathtub according to claim 1, wherein the remote control means is installed on an inner wall surface of the bathroom.

* * * * *